US006739321B1

(12) United States Patent
Puchlerz

(10) Patent No.: US 6,739,321 B1
(45) Date of Patent: May 25, 2004

(54) ARROW REST FOR ARCHERY BOW

(76) Inventor: Dennis M. Puchlerz, 3911 Mapleton Rd., North Tonawanda, NY (US) 14120

( * ) Notice: Subject to any disclaimer, the term of this patent is extended or adjusted under 35 U.S.C. 154(b) by 0 days.

(21) Appl. No.: 10/186,098

(22) Filed: Jun. 28, 2002

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 4,453,528 A * 6/1984 Eckert
5,327,877 A * 7/1994 Shaw ..... 124/44.5 X
5,365,912 A * 11/1994 Pittman ..... 124/44.5
5,460,151 A * 10/1995 Hamilton et al. ..... 124/44.5
5,490,492 A * 2/1996 Savage ..... 124/44.5
6,044,832 A * 4/2000 Piersons ..... 124/44.5
6,202,635 B1 * 3/2001 Evans ..... 124/44.5

* cited by examiner

*Primary Examiner*—John A. Ricci
(74) *Attorney, Agent, or Firm*—Gregory J. Nelson

(57) ABSTRACT

An arrow rest attachable to a bow to steady an arrow as the bow is drawn and the arrow aimed. The rest has a pivot arm which carries an arrow support having a seat. The pivot arm is normally biased to an out-of-the-way position. A tether extends between the pivot arm and a bowstring will raise the arm to a launching position. When the arrow is released, the pivot arm and support will quickly drop out of the way so as to not interfere with the flight of the arrow.

9 Claims, 7 Drawing Sheets

ARROW REST FOR ARCHERY BOW

FIELD OF THE INVENTION

The present invention relates to an accessory for an archery bow and more particularly to an arrow rest for an archery bow.

BACKGROUND OF THE INVENTION

Arrow rests for archery bows are commonly used and provided to support an arrow before and during release. Arrow rests are usually positioned on a lateral extension of the mid portion of the bow and permit the archer to steady and accurately aim and release the arrow from the bow.

When an arrow is released or launched from a bow, it is quickly accelerated from a resting state to a velocity of perhaps several hundred feet per second. The propulsive force, upon release, may also impart a lateral, upward torque to the arrow causing the arrow to deviate from its desired flight path. The arrow may contact the arrow rest during release which can detrimentally effect the intended flight path. Accordingly, it is preferred that an arrow rest not disturb or interfere with the intended flight of the arrow, even if the arrow engages the arrow rest during launching of the arrow.

A number of prior art patents are directed to arrow rest assemblies. U.S. Pat. No. 3,935,854 shows a device for increasing the accuracy when the vertical depressibility of the arrow rest arms effectively dampens the vertical oscillation of the arrow.

U.S. Pat. No. 4,664,093 discloses another form of arrow rest which includes an arrow launcher support comprising a relatively thin metal strip having a rectangular shape portion at one end and a U-shape notch at the other end for supporting the arrow shaft.

U.S. Pat. No. 5,137,006 shows an improved arrow rest having an arm adjustably mounted to the bow handle and a vertically depressible arrow launcher support connected to the arm and moveable to and from the arm by a shuttle.

U.S. Pat. No. 5,529,049 shows an arrow rest assembly for use in archery that does not disturb the intended flight path of the arrow even if the arrow contacts the arrow rest.

Other patents of interest in this area are U.S. Pat. Nos. 5,253,633; 5,365,915; 5,685,267 and 6,021,769. A problem with many prior art designs is that they rely on plungers that do not quickly and effectively clear out of the path of the arrow.

BRIEF SUMMARY OF THE INVENTION

Briefly, it is a primary object of the present invention to provide an arrow rest that will quickly drop out of the path of the arrow once released to eliminate any possible disturbance or interference that may adversely effect the intended flight path of the arrow.

It is another object of the present invention to provide an arrow rest which is adapted to be used with bows of different types and may be utilized with both right- and left-handed archery bows.

The present invention is directed to an arrow rest for archery use that does not disturb the intended flight path of the arrow as it will rapidly drop or pivot out of the way as the arrow is released.

The arrow rest of the present invention includes an elongate mounting bracket defining a slot so the bracket may be attached to a mounting location on the bow. The mounting location is generally a tapped hole in the bow handle and the bracket secured by a fastener such as a bolt. The bracket is normally mounted in a generally horizontal position above the grip of the bow and is locked in a position by a set screw. An arm is pivotally secured to the outer end of the bracket. The arm pivots about the end of a bolt that extends through a threaded bore in the bracket so that, by turning the bolt in one direction or the other, the spacing between the bracket and pivot arm can be selectively adjusted to accommodate the particular bow and the preference of the user.

A torsion spring biases the pivot arm to a generally downward or vertical position with respect to the bracket. A stop pin extends from the bracket and will engage a projection on the arm when the arm is rotated to a generally horizontal position as the bowstring is drawn.

An arrow support is carried on a shaft extending from the end of the pivot arm. The arrow support includes a spool having opposite rims forming a generally V-shape or U-shape seat in which the shaft of the arrow rests. The pivot arm also has a connector for one end of a tether. The opposite end of the tether is attachable to the "up" bowstring or cable so that when an arrow is placed in a shooting position with the arrow shaft resting in the support and the bowstring drawn, the pivot arm will be caused to rotate upwardly bringing the arm to a generally horizontal position. When the bowstring is released, the tether is also released allowing the pivot arm, which carries the arrow support, to rapidly pivot or drop downwardly so it is in an out of the way position, avoiding interference with the launched arrow.

The arrow rest of the present invention is adaptable to use with most conventional and compound bows and can be assembled for both right and left handed archers.

BRIEF DESCRIPTION OF THE DRAWINGS

The above and other objects and advantages of the present invention will become more apparent from the description, claims and drawings in which:

DETAILED DESCRIPTION OF THE DRAWINGS

Figure 1:
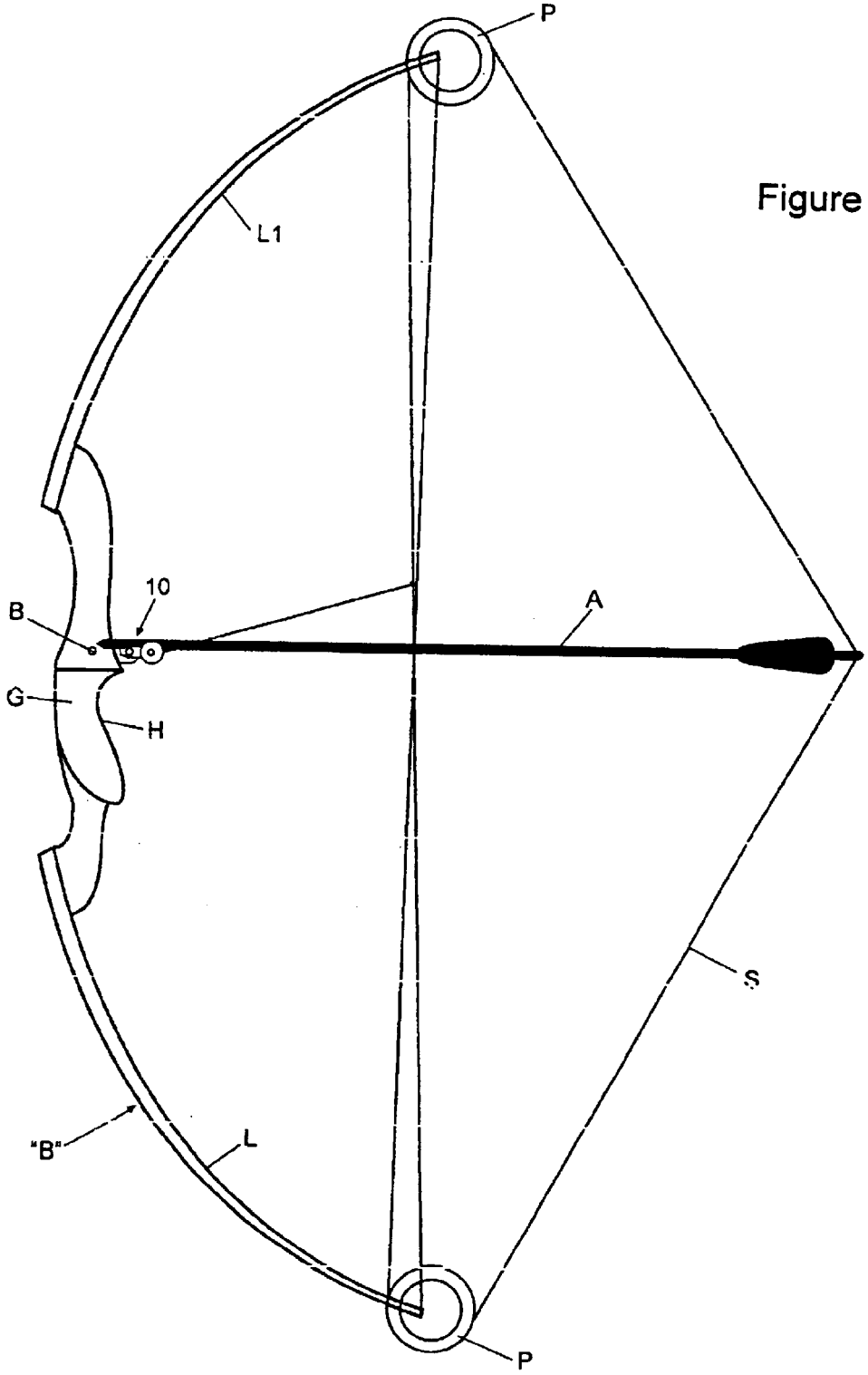
FIG. 1 is a side elevation view showing the arrow rest of the present invention secured to an archery bow of the compound bow type with an arrow in the drawn position and the rest in an "up" position.

Turning now to the drawings, particularly FIG. 1, a representative bow "B" is shown which is shown as a compound bow of the type having intermediate handle portion H with a grip G and opposite upper and lower limbs L and L1. The bow may be constructed of any suitable material and commonly bows of this type have limbs of fiberglass or laminated composite materials. Typically the bow will include an arrow rest in the area of the grip which is generally a ledge on which the arrow rests. Bows of this type are usually either setup for a right-handed or left-handed shooter and will include a threaded bore B in the area of the grip.

The arrow rest 10 of the present invention is securable to the threaded bore B conventionally provided on bows of this type. The bow has a bowstring S which is connected to one or more pulleys or cams P at either end of the upper and lower limbs. Pulley systems, as is well known, allow the user to more easily draw the bowstring, particularly bowstrings which are tensioned to provide greater power. An arrow A is readied for launching by placing the nock of the arrow in engagement with the bowstring and aligning the tip of the arrow with the intended target path. As discussed above, it is common to attach various types of arrow rests or incorporate arrow rests in the grip portion to assist in steading the arrow during the aiming procedure.

It will be appreciate that although a compound bow B is shown for purposes of illustration, the arrow rest of the present invention may be used with bows of various other types. Compound bows are generally used for serious target shooting as well as for hunting because of their accuracy, power and range.

Figure 2:
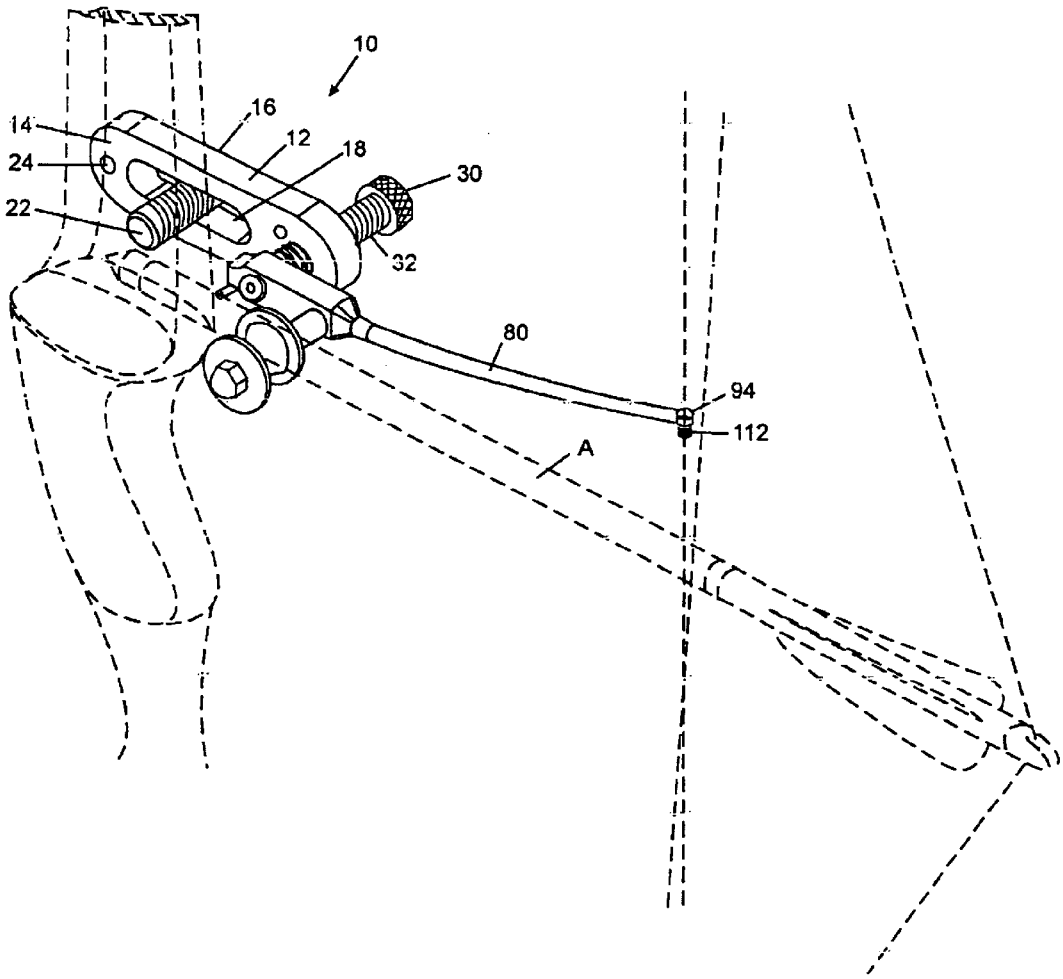
FIG. 2 is a detail view of the grip portion of a bow showing the arrow rest attached to the bow in a location for right handed archers with an arrow shown in a ready to launch position.

A preferred embodiment of the arrow rest of the present invention is shown designated by the numeral 10. The arrow rest, for purposes of illustration in FIGS. 1, 2, 2A and 4, is shown oriented for a right handed archer. In this case, the arrow rest 10 of the present invention is secured to the right hand surface of the bow in the grip area with the arrow support extending rearwardly and transversely of the bow grip so that the arrow, in the launching position, extends along the left side of the bow handle as seen in FIG. 2. The arrow rest 10 includes an elongate mounting bracket 12 having opposite sides 14, 16 and defining a longitudinal slot 18 extending therein. The longitudinal slot 18 is adapted to receive a fastener such as a bolt or screw 22 which is engaged in the threaded bore B provided in the bow handle. A small through bore 24 is provided in the distal end of the bracket between the end of the slot and the end of the bracket. The through bore 24 is threaded to receive a setscrew 26 which may be tightened against the bow to prevent twisting and movement of the bracket once it is properly in position.

Figure 2A:
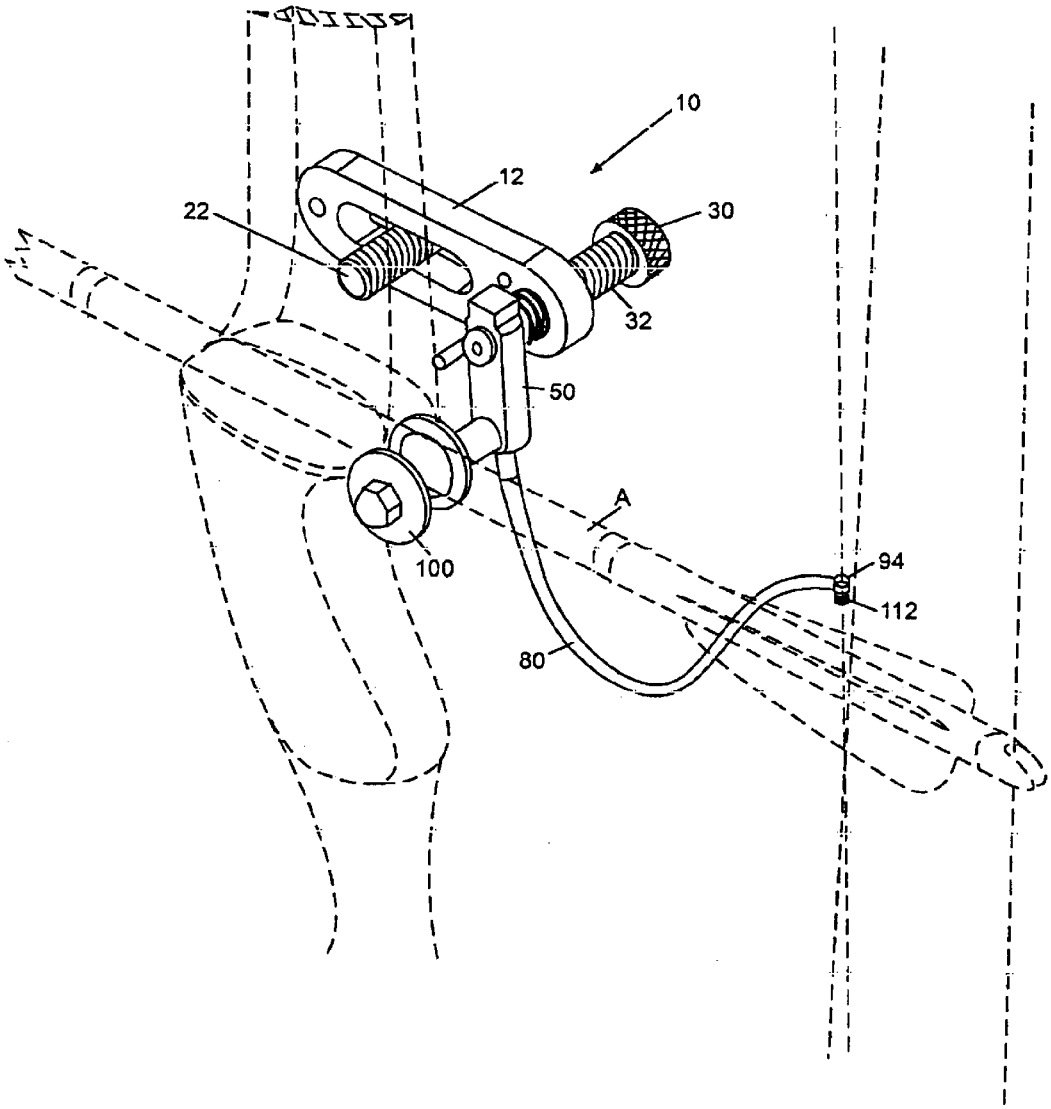
FIG. 2A is a view similar to FIG. 2 with the arrow rest shown in an out-of-the-way or "down" position.

The forward, or proximal end, of the bracket defines a larger threaded through bore 28 which receives a bolt 30. The bolt 30 has a threaded body 32 of sufficient length to extend through the bracket and project beyond side 14 of the bracket as seen in FIGS. 2 and 2A. One end of the bolt carries a knurled knob 34 and a locknut 35 is in threaded engagement with the body of the bolt. Once the bolt has been engaged in the bore 28 and adjusted relative to the bracket so that the rest is properly positioned the locknut 35 can then be tightened against the opposite side 16 of the bracket to prevent the bolt 30 from turning.

The end of bolt 30 is counter-bored at 36 and is devoid of threads along distal section 40 to provide a pivot location. A shoulder 42 is established at the intersection of the threaded body and the unthreaded section 40.

Pivot arm 50 is provided with bore 52. The end section 40 of the bolt 30 extends into the bore 52 so the arm 50 is pivotal about the end of the bolt. The arm is retained by a screw 55 engaging threaded bore 36. A torsion spring 60 extends about the bolt interposed between the arm and the bracket having one end 62 engaging the arm 50 and the opposite end 63 engageable in aperture 64 in the bracket to normally bias or urge the arm downwardly, to the position shown in dotted lines in FIG. 2A.

Figure 4:
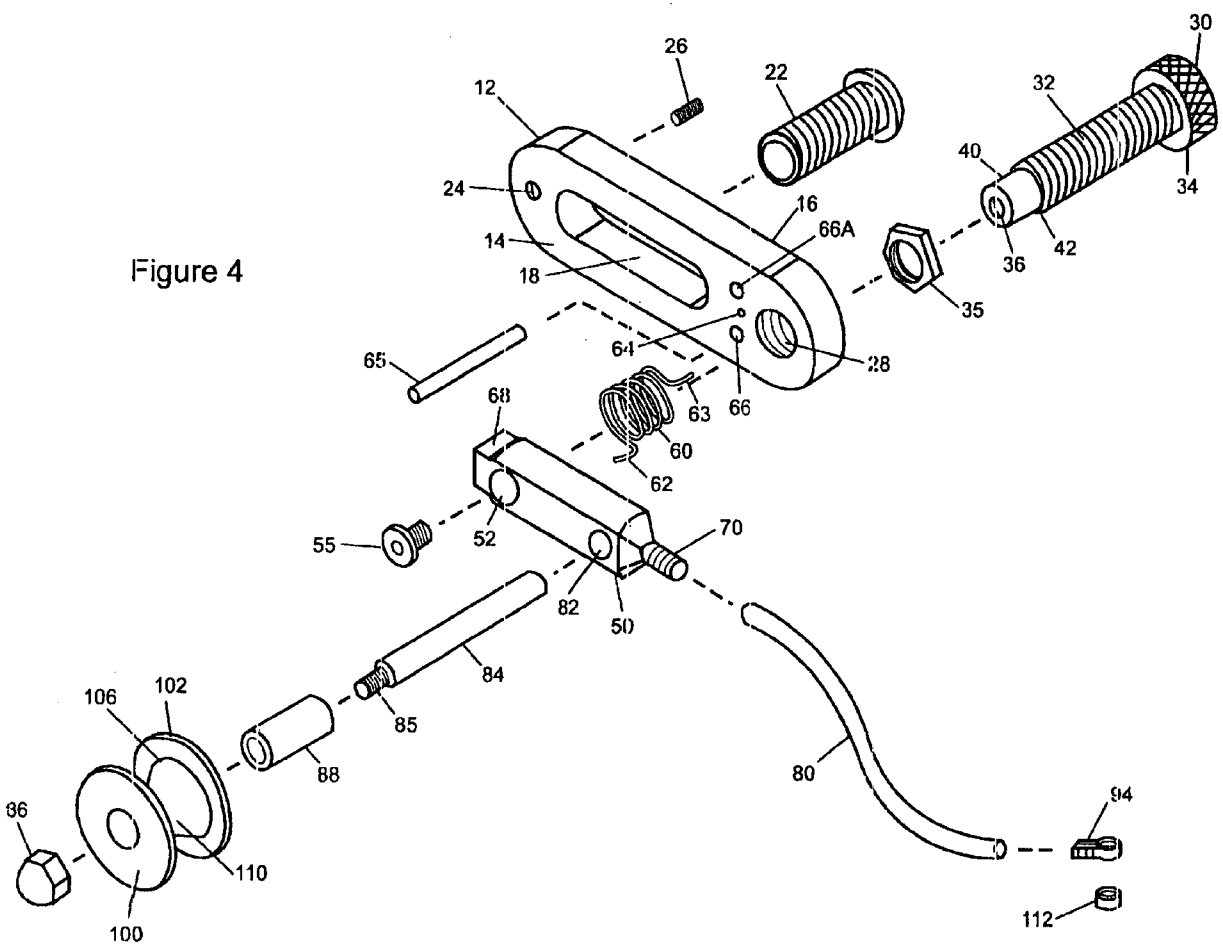
FIG. 4 is an exploded view of the arrow rest of the present invention shown in a right handed configuration.

A stop pin 65 extends from the side of the bracket to a location past the arm. The pin is engageable in one of two holes 66, 66A in the bracket wall depending on the selected mounting orientation. For right handed archers, pin 65 is inserted into lower hole 66. The end of the arm 50 is provided with a shoulder 68 which will engage the pin 65 to limit the upward travel of the arm so that in the launching position the arm is generally axially aligned with the bracket as seen in FIG. 4. The opposite end of the arm 50 carries a connector 70 which is shown having ribs for better frictional engagement and, as will be explained hereafter, is attached to a tether 80.

Inward of the connector, a bore 82 is provided in the arm which receives a shaft 84 which, for right handed set up, extends leftward from the arm rearwardly of the bow as shown in FIGS. 2 and 2A. In the mounted position, the shaft will project to a location approximately aligned with the left side of the bow handle. The shaft is threaded on its outer end at 85 and carries arrow support 100. A cylindrical spacer 88 is interposed between the arm and the support about shaft 84. A cap nut 86 is in engagement with the threaded end 85 of the shaft to maintain the spacer and support wheel in position. The support 100 is rotative about the shaft 84.

Preferably the support 100 is fabricated from a light weight, low friction material such as nylon or Delrin and is a spool having spaced-apart, opposite circular rims 102 interconnected by a core 106. The core 106 defines a generally V- or U-shaped seat 110 configured to loosely receive and steady the arrow shaft resting in the seat 110.

For a right handed archer, the arrow rest 100 is installed as shown in FIGS. 2 and 2A with fastener 22 extending through the bracket 12 engaged in the threaded bore B in the right side of the bow handle. The setscrew 26 is tightened against the bow to lock the bracket in position. Locknut 35 is loosened and bolt 30 is adjusted to establish the desired position of the bracket and the pivot arm. Tether 80 is attached to the serrated connector 70 on the pivot arm 50. The tether is preferably a strong cord or tube of rubber, or similar material, having some elasticity, it being found that surgical tubing works well. One end of the tether may be attached to connector 70 on the pivot arm. In the case of tubing, it can be slipped over the connector. The opposite end of the cord has an eyelet 94 which is attachable to a cable or string of the bow and secured to the tether by crimping. A nock 112 is attached to the string or cable to restrain the tether from sliding downwardly. Accordingly, when the bowstring is drawn rearwardly, the tether will be placed under tension and will cause the pivot arm 50 to pivot upwardly to a generally horizontal position as seen in FIG. 2. In this position, the arrow will rest in the seat of the support to steady the arrow. The nock of the arrow is engaged with the bowstring and manually held in place by the user. When the arrow is launched, spring 60 applies a downwardly biasing force to the pivot arm 50, causing the pivot arm to quickly rotate downwardly and out of the way to minimize the possibility of interference with the arrow as it is launched thereby increasing accuracy. The following is a more detailed description of the operation and use of the arrow rest.

OPERATION

The rest is horizontally mounted with the pivot arm and support in a vertical position as seen in FIG. 2. Tether 80 is connected to the "up" cable or bowstring extending from the pivot arm. When the bow is drawn back, the "up" cable rises, lifting the pivot arm and support, steadying the arrow in a locked position ready to shoot. When released, the support drops down, out-of-the-way, to not interfere or deflect the arrow flight, increasing the speed and accuracy.

MOUNTING

The pivot arm should then be in a vertical or dropped position and attached to the bow by bolt 22 and setscrew 26. The tether 80 is connected to the "up" cable of the bow. To determine which cable is the "up" cable, the archer will draw back the bow and watch for the cable that rises. The location to which the tether is connected and the overall length of the tether will vary depending on the bow. The best way to determine the proper length and the proper location of the tether is to measure with the assistance of another person according to the following procedure.

1. Draw back the bow without an arrow and have another person move the tether to the "up" cable holding it level and about ½" above the rest, taut enough to maintain the pivot arm and support in the "up" position.
2. Mark the tether and the cable at the point of intersection and ease the draw back down. Never release the string of a bow without an arrow in place.
3. Slide the eyelet 94 onto the up cable where the mark was placed.
4. Cut the tether at the mark and slide the cut end of the tether onto the eyelet.
5. Draw back the bow again and inspect the rest to be certain the pivot arm and support are in the "up" position. Make any additional adjustments as needed. (Shorten tether, move eyelet up or down on cable.)
6. After all adjustments have been made, secure the eyelet 94 to the cable with a nock 112, clamping the nock directly below the eyelet.
7. Finally, check the rest using an arrow and make any final adjustments as needed.

Adjustments for Centering an Arrow

1. With the rest in the "up" position, make certain a nocked arrow is square with the bowstring.
2. Loosen the lock nut 35 and turn the threaded, ferruled bolt 30 in or out to make left or right adjustments to center the arrow. Be sure to retighten the lock nut 35 while holding the bolt after adjustments have been made.

Figure 3:
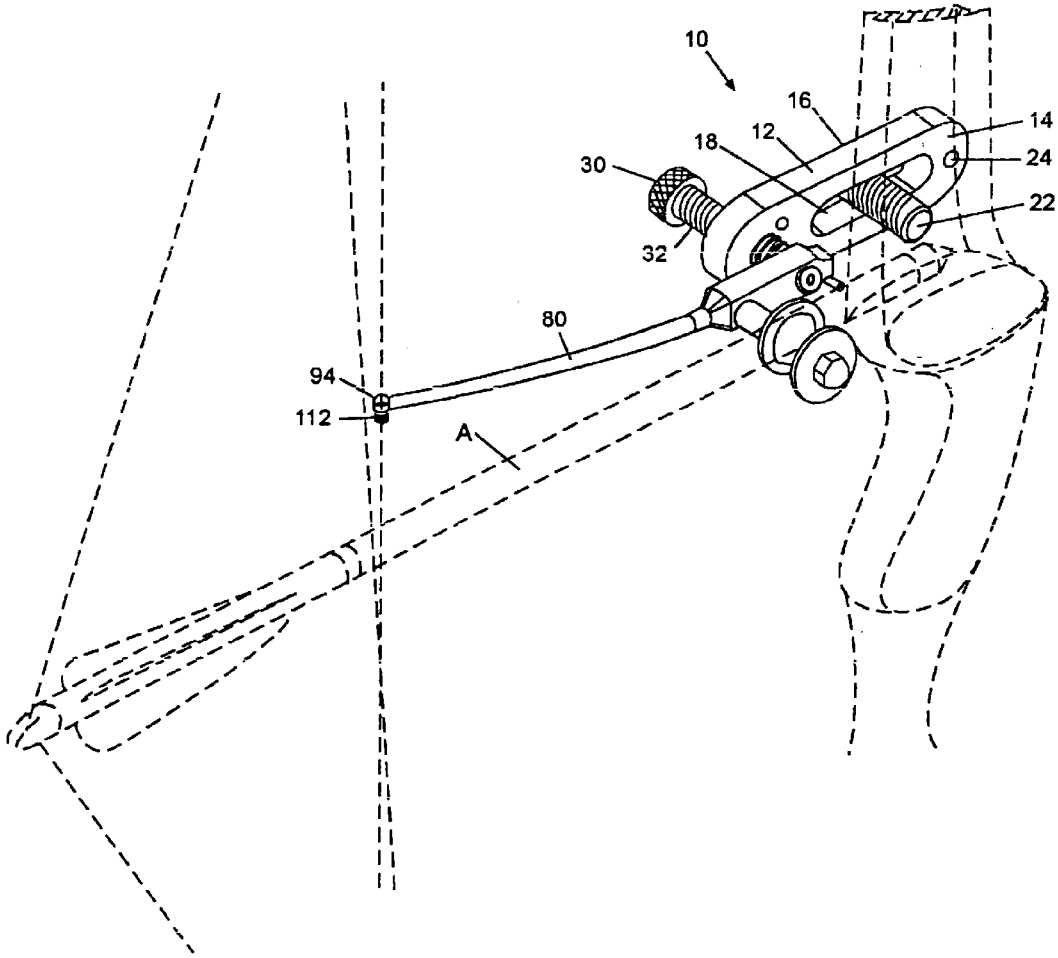
FIG. 3 is a detail view of the rest in an "up" position configured for left handed archers.
Figure 3A:
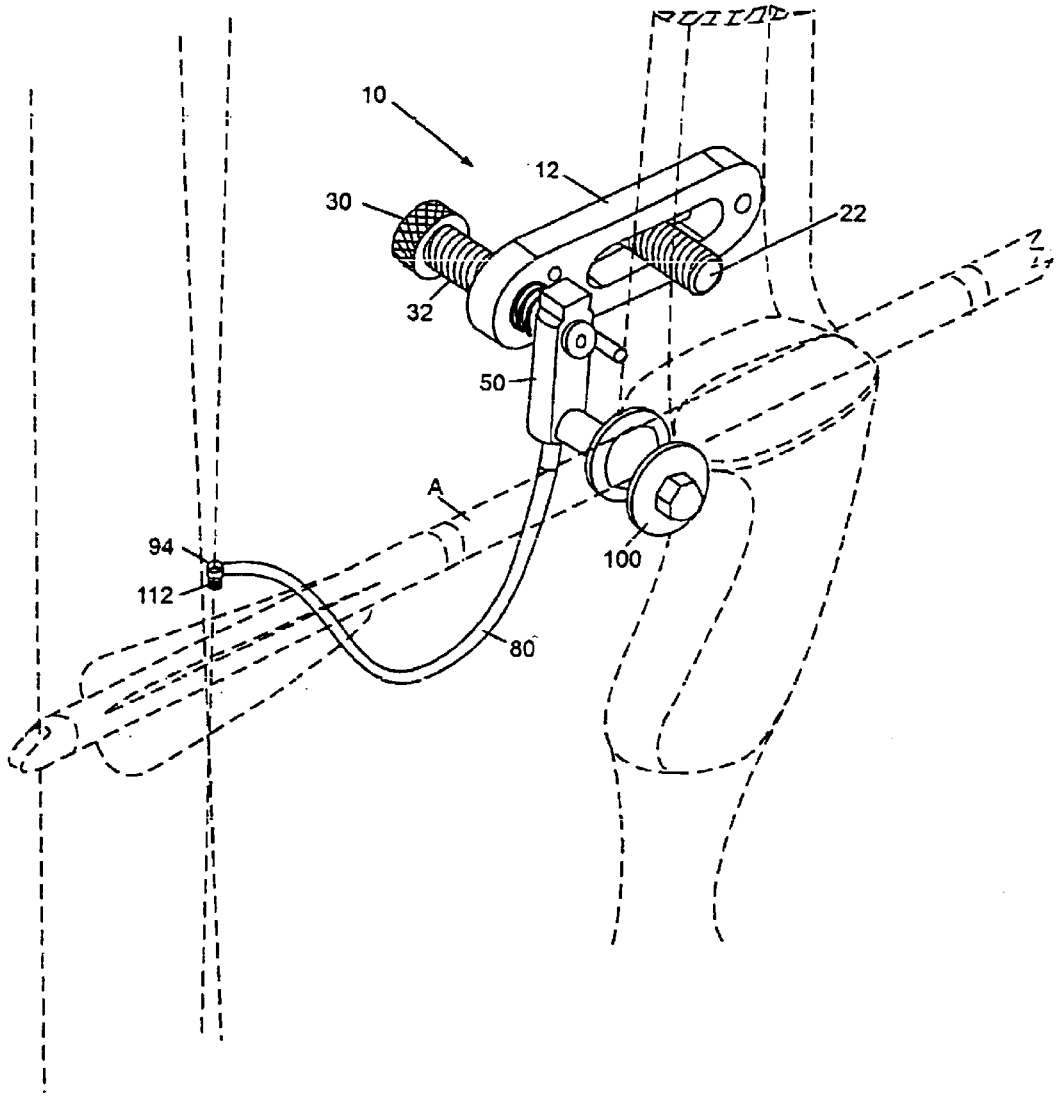
FIG. 3A is a view similar to FIG. 3 with the arrow rest in an out-of-the-way, "down" position.
Figure 4A:
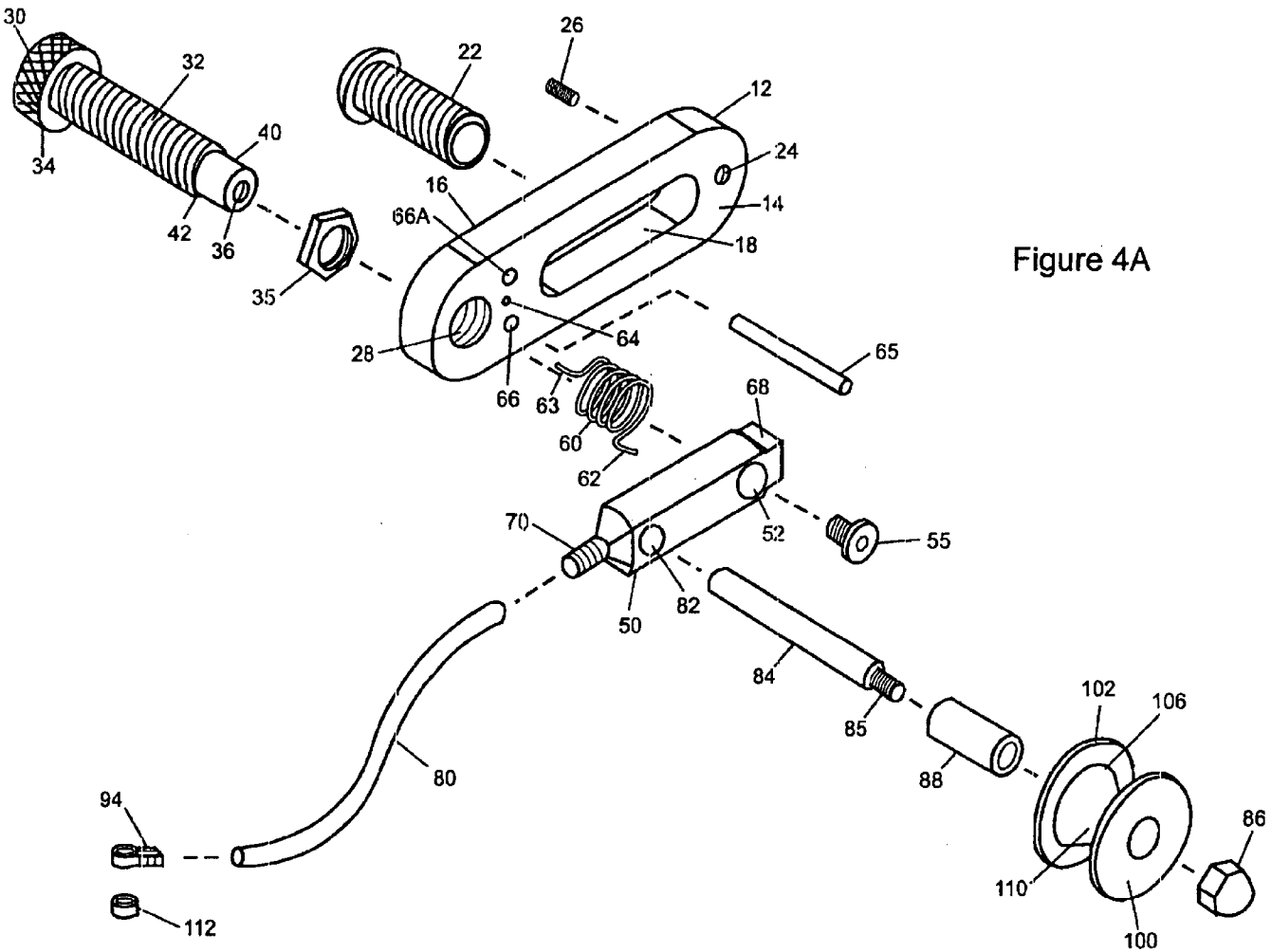
FIG. 4A is an exploded view of the arrow rest of the present invention shown in a left handed configuration.

In order to convert the arrow rest for use with a left hand bow, the components can be disassembled and reassembled as shown in FIGS. 3, 3A. The same numerals have been used to identify the same components in these drawing figures. The adjustment bolt 30 extends through the threaded bore in the end of the bracket 12 and carries the pivot arm 50 to which is attached the support. The stop pin 65, which is press-fit into the lower bore 66, will be removed and pressed into the upper bore 66A. The tether 80 is again attached to the connector 70 on the end of the pivot arm with the opposite end of the tether being extended and attached to the "up" cable. Thus, as seen in FIG. 4A, when the tether is drawn taught as the bowstring is drawn, the pivot arm will again assume a generally horizontal position with the bracket now being mounted on the left side of the bow and the arrow support wheel extending rearwardly of the bow grip to the right side of the bow suitable for use by a left handed archer.

From the foregoing, it will be seen that the present invention provides a simple, reliable and inexpensive device which is useable with both right and left hand bows to allow the archer to better control and accurately aim the arrow. The arrow rest support will remain in position only during the aiming operation. Once the arrow is released, the wheel will quickly drop out of the way so as to avoid interference with the launching of the arrow.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. An arrow rest for an archery bow having a bowstring, said rest comprising:

(a) a bracket securable to the said bow;

(b) a pivot arm pivotally carried on said bracket, said pivot arm having a first launching position and a second out-of-the-way position, said first launching position being generally horizontal and said second position being generally vertical;

(c) biasing means normally urging said pivot arm to said second position;

(d) an arrow support carried on said pivot arm for supporting an arrow for launching when said pivot arm is in said first position; and (e) a tether attachable to said bowstring and to said pivot arm to pivot said arm from said second position to said first position when said bowstring is drawn.

2. The arrow rest of claim 1 wherein said bracket includes stop means engaging said arm in said first launching position.

3. The arrow rest of claim 1 further including fastener means in threaded engagement with said bracket and engageable with said bow to maintain said bracket in a fixed position.

4. The arrow rest of claim 1 wherein said arrow support is a rotatable spool defining an arrow shaft receiving seat.

5. An arrow rest for attachment to an archery bow having a drawstring, said arrow rest comprising:

(a) a bracket defining an elongate slot and a bore;

(b) a fastener engageable in said bore to extend through said bracket, said fastener having a pivot section at its distal end;

(c) a pivot arm carried on the distal end of said fastener having a generally horizontal firing position and a generally vertical out-of-the-way down position;

(d) spring means interposed between said bracket and arm normally urging said pivot arm to said first down position;

(e) stop means on said bracket;

(f) an arrow support mounted on said pivot arm having an arrow receiving seat for supporting an arrow for launching; and (g) a tether extending between said pivot arm and said bowstring to pivot said pivot arm to a firing position against said stop when the bowstring is drawn.

6. The arrow rest of claim 5 wherein said spring means comprise a torsion spring having its ends engaged in said arm and bracket.

7. The arrow rest of claim 5 wherein said arrow support is rotatably mounted.

8. The arrow rest of claim 5 wherein said bracket includes a setscrew engageable with said bow.

9. An arrow rest for attachment to an archery bow having a drawstring, said arrow rest comprising:

(a) a bracket defining an elongate slot and a bore;

(b) a fastener engageable in said bore to extend through said bracket, said fastener having a pivot section at its distal end;

(c) a pivot arm carried on the distal end of said fastener having a generally horizontal firing position and an a generally vertical out-of-the-way down position;

(d) spring means interposed between said bracket and pivot arm normally urging said pivot arm to said first downward position;

(e) stop means on said bracket, said stops means being positioned on said bracket to selectively orient the arrow rest for either right or left handed archers;

(f) an arrow support mounted on said pivot arm having an arrow receiving seat for supporting an arrow for launching; and (g) a tether extending between said pivot arm and said bowstring to pivot said pivot arm to a firing position against said stop when the bowstring is drawn.

* * * * *